United States Patent [19]

Cass et al.

[11] 4,093,451

[45] June 6, 1978

[54] COKE AGGLOMERATE AND METHOD OF UTILIZING SAME

[75] Inventors: Boyd E. Cass, Ligonier; David W. Coate; Joseph R. Quigley, both of Pittsburgh, all of Pa.

[73] Assignee: Cardd, Inc., Pittsburgh, Pa.

[21] Appl. No.: 837,531

[22] Filed: Sep. 28, 1977

[51] Int. Cl.[2] ..... C22B 1/08

[52] U.S. Cl. ..... 75/43; 44/16 A; 75/3; 75/42; 75/44 R; 75/53; 75/257; 264/109; 264/176 R

[58] Field of Search ..... 75/3, 43, 44 R, 44 S, 75/53, 42, 257; 44/16 A, 26; 264/109, 176 R

[56] References Cited

U.S. PATENT DOCUMENTS

| | | | |
|---|---|---|---|
| 2,540,173 | 2/1951 | Olivo | 75/44 R |
| 3,762,886 | 10/1973 | Triska | 44/16 A |
| 4,015,977 | 4/1977 | Crawford | 75/43 |
| 4,051,213 | 9/1977 | Kooy et al. | 264/109 |

*Primary Examiner*—M. J. Andrews

*Attorney, Agent, or Firm*—Carothers and Carothers

[57] ABSTRACT

A coke agglomerate for use in metallurgical furnaces and the like which is manufactured by mixing by weight 30–70% metallurgical coke screenings, 5–15% hydraulic cement, and 15–55% of at least one finely divided calcium-bearing material selected from the group consisting of calcium hydroxide, calcium carbonate, and calcium fluoride, with sufficient water to form a plastic agglomerable mixture. The mixture is then agglomerated by molding or extrusion to an adequately large agglomerate size and then cured.

23 Claims, 1 Drawing Figure

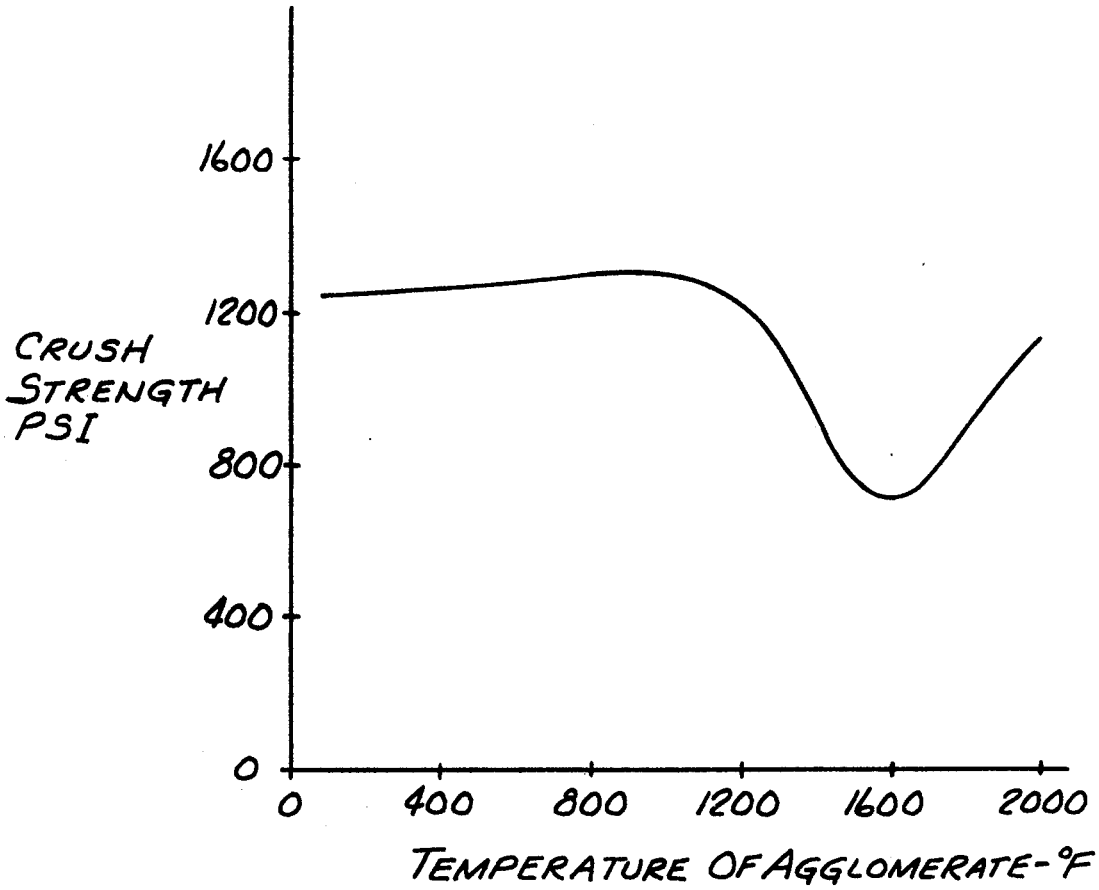
1600
1200
800
400
0
CRUSH STRENGTH PSI
0
400
800
1200
1600
2000
TEMPERATURE OF AGGLOMERATE-°F

COKE AGGLOMERATE AND METHOD OF UTILIZING SAME

BACKGROUND OF THE INVENTION

The present invention relates to agglomerates and more particularly to the recovery of coke fines in agglomerate form for use in cupola scrap melting.

As is well known, in basic oxygen steel making, hot metal from a blast furnace is discharged into a basic oxygen furnace for further processing and refinement. The blast furnace produces hot metal by reducing iron ore. The construction and operation of such a blast furnace, however, is an elaborate undertaking and requires a large capital investment.

An alternative method for producing hot metal for a basic oxygen furnace is to melt steel scrap in a cupola furnace. In addition, cupola furnaces may also be used to melt scrap for direct use in foundry casting. In order to melt scrap in such a cupola furnace, scrap, large pieces of coke, and other ingredients are charged together into the furnace. Air is then bottom blown through tuyeres to ignite the coke and thus melt the scrap. Other ingredients often added to a cupola furnace include limestone and fluorspar or other slag conditioning agents. These ingredients assist in making a slag which is used to remove impurities such as sulfur which are introduced into the steel through the coke.

Cupola furnaces differ from blast furnaces in their need or requirement for large particle charges. Blast furnaces, for example, are generally charged with ingredients having a particle size diameter between ½ and 2 inches. Cupola furnaces, on the other hand, operate under low pressures and require larger sized particles, generally between 2 and 10 inches in diameter.

For example, before coke is charged along with scrap and other ingredients in a cupola furnace, the coke is generally screened over a 2 or 3 inch screen. The coke particles having a size greater than 2 inches are then charged into the furnace, and the remainder of the coke screenings are discarded or resold at a lower price due to their undesirable small size. The minus 2 inch coke screenings which are generally discarded are not utilized in cupola furnaces, as they tend to fill the void spaces therein which are necessary for the free movement of combustion air at low pressures across the charge bed.

It is a principal object of the present invention to agglomerate these normally discarded coke screenings into a useable form for cupola scrap melting operations, or any other process which requires the use of coke agglomerates. The necessary parameters for such an agglomerate are as follows: (1) the agglomerate must combine the undersized coke into a large coherent piece or size to allow for proper gas flow in the furnace; (2) the agglomerate must have sufficient load bearing capabilities to maintain its integrity at elevated temperatures in the furnace; (3) the agglomerate should be sufficiently strong to withstand handling and charging into the furnace; and (4) the agglomerate should introduce a minimum of undesirable elements into the scrap melting operation.

The present inventors have discovered such an agglomerate for use in metallurgical processes as will be described in more detail hereinafter.

SUMMARY OF THE INVENTION

The coke agglomerate of the present invention consists of a mixture, by weight, of 30–70% coke fines or metallurgical coke screenings, 5–15% hydraulic cement, and 15–65% of one or more finely divided calcium bearing material selected from the group consisting of calcium hydroxide, calcium carbonate, and/or calcium fluoride. Sufficient water is added to the mixture to provide a plastic agglomerable mixture which is thereafter agglomerated by molding or extrusion to agglomerates of desired size and shape for introduction into a cupola furnace, blast furnace, B.O.F. or other furnace. The agglomerates are suitably cured before handling and charging to the furnace.

The amount of water which is added to the mixture before agglomerating will generally fall within the range of 10–20% by weight of the mixture.

It has further been found advantageous when extrusion is utilized for agglomeration to carry out the extrusion under a partial vacuum.

It is also desirable that the metallurgical coke screenings have a relatively uniform distribution of particle sizes wherein the largest is no more than approximately 3 inches.

Other objects and advantages appear in the following description and claims.

DISCUSSION OF THE PREFERRED EMBODIMENTS

The present inventors have found that the following composition meets the aforementioned requirements of necessary parameters for an agglomerate of coke screenings useable in cupola scrap melting operations: 30–70% metallurgical coke screenings, 5–15% hydraulic cement, and 15–65% of at least one finely divided calcium bearing material selected from the group consisting of calcium hydroxide, calcium carbonate and calcium fluoride. By hydraulic cement, it is meant any finely divided particles which set to a hard product with the addition of water, which combines chemically with the other ingredients to form a hydrate. Generally, hydraulic cements contain lime, alumina and silicon.

It is found that the fine particle hydraulic cement when mixed with one or more of the aforementioned calcium bearing compounds and the coke serves to (1) give good adhesion to the coke particles thus producing an agglomerate having sufficient strength for handling, (2) form a matrix which has sufficient strength at elevated temperatures to function satisfactorily in a cupola furnace, (3) create a material having sufficient green strength, such that it can be molded into the desired shape and allowed to cure, and (4) add a minimum of undesirable elements to the scrap melting operation. The calcium bearing compounds in the mixture are all desirable elements in that they contribute to the chemistry necessary for slag formation. The cement ingredient is very similar in chemistry to the ash that is present in coke, thus introducing no unexpected or unmanagable elements.

An additional advantage to the composition of the present invention is the ability to form agglomerates which have a variety of desired sizes and shapes. The aforementioned coke, cement and other finely divided calcium bearing materials are mixed together with water to make a plastic mass which may be vibrated or packed in molds of desired shapes or extruded through a die. After removal from the mold or extruder, the green shapes are set aside for curing. Thus, by merely changing the shape or size of the molds or dies, one can thus change the dimensions of the final agglomerate.

For large tonnage production operations, this composition of matter is well suited for use with either conventional cement block making equipment or large auger extruders. For example, this composition can be processed on a cement block making press or through a clay processing extruder to produce blocks or other shapes for use in a cupola furnace.

A cement block making press employs a vibration ram action for compacting the plastic material into a mold to produce green agglomerates. The clay extruder employs a rotating helical auger to force the plastic material through a die. The manufacture of the agglomerate on a cement block machine requires the following steps: mixing, forming, demolding, and curing. The manufacture of this composition on a clay extruder requires the steps of mixing, extruding and curing.

The step of mixing can be carried out in any conventional mixer which will give adequate mixing in a wet condition. It is desirable that the coke screenings, which constitute 30–70% of the mix, have a fairly uniform distribution of particle size from 1–2 inch top size down to 8–20 mesh or smaller bottom size. If calcium fluoride is used as the calcium bearing component, it is further preferable that this be provided in the form of fluorspar fines such as filtercake fluorspar having a majority of its particle sizes less than 60 mesh. If calcium hydroxide or pulverized limestone is used as the calcium bearing component, it is preferable also that the majority of their particle sizes be less than 60 mesh.

If pulverized limestone is utilized, it has been found that both calcium or dolomitic pulverized stone perform satisfactorily in the agglomerate. If calcium hydroxide is employed, it has been found that hydrated lime or finely divided waste products from lime manufacturing operations consisting of high percentages of hydrated lime along with other impurities also performs well.

It is preferable that the cement component have as fine a particle size as possible, generally less than 200 mesh. These components are then mixed together in the aforementioned proportions with water in a suitable mixer until the mixture has a plastic consistency suitable for agglomerate formation. The amount of water added will be a function of the percentage levels of the various components and will generally run between 10 and 20%.

In the process of forming the agglomerate by extrusion, the plastic mass is subjected to pressure and forced through an extrusion die of desired shape. The creation of the plastic mass may be done in a separate mixer or may be carried out in a pug mill which is attached to the same shaft as the helical augers of the extruder. In other words, it may be one section of the extrusion apparatus itself.

A further advantage to extrusion can be realized by utilizing an extruder with a de-airing chamber. This type of extruder employs an additional sealing auger attached to a common chamber with the main auger. The plastic material flows into the chamber from or through the first auger under pressure and forms a seal in so doing, and then flows out of this chamber through the agglomerate forming extrusion die thus forming a second seal. The presence of these two seals of moving material allows one to pull a vacuum on the aforesaid chamber which has the effect of densifying the agglomerate by removing air from around the fine particles. These agglomerates formed under partial vacuum have a higher green strength and generally display a higher ultimate strength than agglomerates formed without vacuum.

After the plastic material has issued from the extrusion die in a continuous column or columns of desired cross section, it is either cut or broken into desired lengths. Once the green agglomerates have been produced, they are then cured.

In forming the agglomerates by molding or by cement block making, the composition is first mixed into a plastic consistency in a suitable mixer and is then charged into molds and evenly distributed throughout the molds with the help of either vibration or mechanical tamping. As in conventional block making technology, release from the mold is generally effected by a rapid movement of the mold cavity upward leaving the green agglomerate on a base plate. Once the green agglomerates are removed from the molds, they must then be cured.

The type of curing employed is determined by the type of cement binder used and the desired speed of curing. The green agglomerates may be cured at room temperature or under conditions of elevated temperatures and high humidity, such as in a steam room. They may also be cured under conditions of a saturated environment having both high temperatures and pressure as in an autoclave.

If Portland cement is used as the binder, then one to two days at room temperature or 8 to 18 hours in a steam room at 180° to 200° F will cure the agglomerate to a state where it can be handled. Ultimate strength from the cement does not develop for another 7 to 14 days.

While Portland cement has been found preferable for this composition, other types of hydraulic cement may also be used, such as alumina cement or mixtures of fly ash and lime. The present inventors have also found that a mixture of 90% finely divided fly ash with 10% hydrated lime can be used to replace up to 50% of the Portland cement in this composition. In general, the use of fly ash-lime mixtures requires an autoclave or steam room cure, as it is slower to set than Portland cement.

Example compositions and methods of forming the agglomerates are given hereinafter to more fully explain and describe the invention.

EXAMPLE 1

Coarse coke screenings, filtercake fluorspar, a wet lime bearing sludge and Portland cement were mixed and formed in a mold to produce a cement hardened agglomerate. 40% wet lime sludge having a moisture content of 45%, 40% dry coke fines having density of 62 lbs. per cubic foot and a screen analysis as indicated below, 10% dry filtercake fluorspar containing 91% calcium fluoride and having a screen analysis as indicated below, and 10% type 1A Portland cement were mixed together in a rotary mixer to form a moist plastic mass.

| Screen Analysis Dry Coke Fines | | Screen Analysis Filtercake Fluorspar | |
|---|---|---|---|
| +½" | 16% | +100 mesh | 10% |
| −½ +¼" | 27% | −100 mesh +325 mesh | 65% |
| −¼" +20 mesh | 39% | −325 mesh | 25% |
| −20 mesh +200 mesh | 12% | | |

-continued

| Screen Analysis Dry Coke Fines | | Screen Analysis Filtercake Fluorspar |
|---|---|---|
| −200 mesh | 6% | |

The wet lime sludge used in this Example is a settling pond product produced from a wet scrubber collector from a lime manufacturing operation. 98.5% of the particles in this sludge pass through a 325 mesh screen. The chemical analysis of the sludge on a dry basis is as follows: $SiO_2$ — 10.03%, $Al_2O_3$ — 3.13%, $Fe_2O_3$ — 2.1%, CaO — 46%, MgO — 0.85% and volatiles 36.57%. This plastic material having a moisture content of 19% was formed into cubical molds having dimensions of 3 inches by 3 inches by 3 inches. Once formed the green bricks were released from the molds by turning them upside down and gently tapping. These bricks were then set aside to cure in a humid environment at 80° F. After 24 hours at 80° F, these bricks had a crush strength of 400 psi. After 7 days at 80° F, they had a crush strength of 1300 psi. Crush strength behavior of these bricks as a function of higher temperatures is graphically illustrated in the accompanying drawing.

The same plastic material was also processed in a de-airing extruder. The extruder consisted of two separate 3 inches diameter helical augers on the same shaft. The rear auger forced the material through a sealing die into the vacuum chamber and the second auger forced the material exiting the vacuum chamber through an agglomerate forming die, which consisted of a 2 inch ID pipe 3 inches long. The green agglomerates were thus 2 inches in diameter and were broken into pieces 2 inches to 3 inches long as they issued from the die. The extruder was set at 30 rpm and agglomerates were made both with and without vacuum. The material made with vacuum was observed to have a higher green and ultimate strength than the material made without vacuum draw.

One application for this agglomerate composition is for use in foundry furnace melting scrap for casting. In such an operation, the furnace charge usually consists of scrap steel, large pieces of coke (generally greater than 2 inches in diameter), limestone, and sometimes fluorspar. The composition of the coke generates the heat necessary to melt the scrap. The limestone and spar go toward making a slag which helps remove impurities which have been added to the metal through the coke. The composition of this example is charged into a scrap melting cupola operation for foundry casting, as all these ingredients are compatible with such a process. Furthermore, an economic advantage is realized, as this composition allows one to utilize cheaper raw materials. For example, the calcium oxide units which go toward forming the slag in this example are derived from lime sludge which is a waste product. This composition also allows for the utilization of coke screenings, yet supplies the cupola with its required large agglomerates at a lower cost.

EXAMPLE 2

The following ingredients were mixed to form large cement hardened agglomerates: coke screenings, filtercake fluorspar, pulverized dolomitic limestone and Portland cement. A screen analysis for these materials is as follows:

| Screen Analysis Fluorspar | | Screen Analysis Coke | |
|---|---|---|---|
| +100 mesh | 10% | −2" +1" | 42% |
| −100 mesh +325 mesh | 65% | −1" +¼" | 35% |
| −325 mesh | 25% | −¼" +20 mesh | 10% |
| | | −20 mesh | 15% |

| Screen Analysis Pulverized Dolomitic Limestone | |
|---|---|
| +20 mesh | 1% |
| −20 mesh +60 mesh | 4% |
| −60 +100 mesh | 10% |
| −100 mesh | 85% |

The following proportions of the above materials were charged and thoroughly mixed in a rotary mixer: 47 lbs. coke screenings having a moisture of 5%, 19.8 lbs. filtercake fluorspar having a moisture of 9%, 37 lbs. of crushed dolomitic limestone, 10 lbs. of type 1A Portland cement, and 11 lbs. of water. The resulting plastic mass was hand charged and packed with a hand ram in open-ended cylindrical molds formed from 6 inch long pieces of 5 inch ID cylindrical pipe. The green agglomerates were removed from the mold by gently tapping and simultaneously lifting the pipe, leaving the green agglomerates on a base plate. These cylindrical bricks were then left to cure at room temperature.

A larger batch (1000 lbs.) of the same composition was mixed in a rotary mixer to produce a plastic mass. This material was charged into an extruder having a helical auger tapered from 12 inches in diameter at the rear to 9 inches in diameter at the tip. The auger was set at 30 rpm and forced the material through a cylindrical pipe die 5 inches in diameter and 6 inches long. The 5 inch diameter green extrusions were broken into pieces from 5 inches to 7 inches long as they issued from the end of the extruder. These cylindrical agglomerates were also left to cure at room temperature.

In order to test the strength of these agglomerates, a test was devised whereby the agglomerates were dropped from increasing heights on to a cement floor until they fractured significantly. Significant fracture was defined as when after dropping, the agglomerate lost through fracture, more than 20% of its original weight. After 24 hours at room temperature, the cylindrical bricks (weighing approximately 8 lbs.) could be dropped from heights up to 3 feet before significant fracture. The following table was made by utilizing this drop test and shows agglomerate strength as a function of curing time and temperature. Equivalent results were obtained for agglomerates made by molding versus extrusion.

| Drop Height to Significant Fracture | No. Days Curing At Room Temp. | Temp. of Agglomerate When Dropped |
|---|---|---|
| 3 feet | 1 | Room Temp. |
| 10 feet | 3 | Room Temp. |
| 25 feet | 7 | Room Temp. |
| 30 Feet | 14 | Room Temp |

| Drop Height to Significant Fracture | No. Days Curing At Room Temp. | Agglomerates Were Heated In Furnace and Were Dropped at These Temperatures |
|---|---|---|
| 27 feet | 14 | 300° F |
| 18 feet | 14 | 900° F |
| 12 feet | 14 | 1500° F |

-continued

| Drop Height to Significant Fracture | No. Days Curing At Room Temp. | Agglomerates Were Heated In Furnace and Were Dropped at These Temperatures |
|---|---|---|
| 8 feet | 14 | 2000° F |

This composition of matter produces very strong agglomerates which profitably recycle coke screenings in the form of large agglomerates without adding undesirable impurities. The composition forms green agglomerates having excellent strength and which are very well suited for mass production on conventional cement block making equipment or on conventional extrusion equipment. These bricks can be employed, for example, to recycle coke fines in a cupola furnace melting scrap to produce hot metal for a b.o.f. furnace. The agglomerates are large enough to allow for proper gas flow in the furnace and have sufficient strength at high temperatures to maintain their integrity in the furnace environment. The fluorspar and the limestone present in the agglomerates are beneficial agents and go towards creation of a proper slag for desulfurization purposes.

We claim:

1. A coke agglomerate consisting essentially of a cured agglomerated mixture by weight of 30–70% coke fines, 5–15% cement on a dry basis, and 15–65% of at least one finely divided calcium bearing material selected from the group consisting of calcium hydroxide, calcium carbonate, and calcium fluoride.

2. The agglomerate of claim 1 wherein the coke fines are metallurgical coke screenings.

3. The agglomerate of claim 1 wherein said coke screenings have a relatively uniform distribution of particle size from approximately 3 inches and lower.

4. The agglomerate of claim 1 wherein said agglomerate is an extruded agglomerate.

5. The agglomerate of claim 1 wherein said agglomerate is a molded agglomerate.

6. The agglomerate of claim 1 wherein the agglomerate is at least 2 inches in diameter.

7. The agglomerate of claim 1 wherein at least a portion of said calcium bearing material is fluorspar fines.

8. The agglomerate of claim 7 wherein said fluorspar fines have a particle size of less than 60 mesh.

9. The agglomerate of claim 1 wherein at least a portion of said calcium bearing material is by-product lime sludge from a lime manufacturing operation.

10. The agglomerate of claim 1 wherein the particle size of said cement is no greater than 200 mesh.

11. The method of recovering coke fines for metallurgical use comprising the steps of: mixing by weight 30–70% coke fines, 5–15% hydraulic cement, and 15–65% of at least one finely divided calcium bearing material selected from the group consisting of calcium hydroxide, calcium carbonate, and calcium fluoride, with sufficient water to form a plastic agglomerable mixture; agglomerating the mixture into agglomerates of desired size and shape; and curing the agglomerates.

12. The method of claim 11 wherein the coke fines are selected from metallurgical coke screenings.

13. The method of claim 12 wherein said coke screenings have a relatively uniform distribution of particle size of no more than 2 inches and smaller.

14. The method of claim 11 including the step of introducing the cured agglomerates into a metallurgical furnace.

15. The method of claim 14 wherein said furnace is a cupola furnace.

16. The method of claim 11 wherein the amount of water added is in the range of 10% to 20% by weight of the mixture.

17. The method of claim 11 wherein the step of agglomerating is carried out by extrusion.

18. The method of claim 17 wherein the step of extrusion is carried out under a partial vacuum.

19. The method of claim 11 wherein the step of agglomerating is carried out by molding.

20. The method of claim 11 wherein at least a portion of said calcium bearing material is fluorspar fines.

21. The method of claim 20 wherein said fluorspar fines have a particle size of less than 60 mesh.

22. The method of claim 11 wherein at least a portion of said calcium bearing material is by-product lime sludge from a lime manufacturing operation.

23. The method of claim 11 wherein the particle size of said cement is no greater than 200 mesh.

* * * * *